US006579444B2

(12) United States Patent
Feimer et al.

(10) Patent No.: US 6,579,444 B2
(45) Date of Patent: Jun. 17, 2003

(54) REMOVAL OF SULFUR COMPOUNDS FROM HYDROCARBON FEEDSTREAMS USING COBALT CONTAINING ADSORBENTS IN THE SUBSTANTIAL ABSENCE OF HYDROGEN

(75) Inventors: Joseph L. Feimer, Bright's Grove (CA); David N. Zinkie, Sarnia (CA); Myles W. Baker, Fairfax, VA (US); Bal K. Kaul, Randolph, NJ (US); Gordon F. Stuntz, Baton Rouge, LA (US); Joseph T. O'Bara, Parsippany, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/022,948

(22) Filed: Dec. 17, 2001

(65) Prior Publication Data

US 2002/0157990 A1 Oct. 31, 2002

Related U.S. Application Data

(60) Provisional application No. 60/258,505, filed on Dec. 28, 2000.

(51) Int. Cl.[7] ..... C10G 29/04

(52) U.S. Cl. ..... 208/243; 208/208 R; 208/244; 585/820

(58) Field of Search ..... 208/208 R, 243, 208/244; 585/820

(56) References Cited

U.S. PATENT DOCUMENTS

| | | | | |
|---|---|---|---|---|
| 2,460,227 | A | 1/1949 | Hart et al. | 208/230 |
| 3,185,641 | A | 5/1965 | Cowden | 208/226 |
| 4,011,882 | A | 3/1977 | Nivens et al. | 137/15 |
| 4,149,965 | A | 4/1979 | Pine et al. | 208/216 R |
| 4,149,966 | A | 4/1979 | O'Donnell et al. | 208/237 |
| 4,464,252 | A | 8/1984 | Eberly, Jr. et al. | 208/243 |
| 4,634,515 | A | 1/1987 | Bailey et al. | 208/91 |
| 4,775,462 | A | 10/1988 | Imai et al. | 208/189 |
| 4,908,122 | A | 3/1990 | Frame et al. | 208/207 |
| 5,157,201 | A | 10/1992 | Norris | 585/820 |
| 5,160,045 | A | 11/1992 | Falkiner et al. | 210/634 |
| 5,199,978 | A | 4/1993 | Poirier et al. | 208/233 |
| 5,250,181 | A | 10/1993 | Falkiner et al. | 210/634 |
| 5,259,946 | A | 11/1993 | Robinson et al. | 208/65 |
| 5,322,615 | A | 6/1994 | Holtermann et al. | 208/91 |
| 5,423,975 | A | 6/1995 | Sudhakar et al. | 208/216 R |
| 5,525,211 | A | 6/1996 | Sudhakar et al. | 208/217 |
| 5,525,233 | A | 6/1996 | Falkiner et al. | 210/638 |
| 5,599,441 | A | 2/1997 | Collins et al. | 208/208 R |
| 5,618,408 | A | 4/1997 | Poirier et al. | 208/370 |
| 5,674,378 | A | 10/1997 | Kraemer et al. | 208/233 |
| 5,807,475 | A | 9/1998 | Kulprathipanja et al. | 208/208 R |
| 5,837,131 | A | 11/1998 | Clark | 208/216 PP |
| 5,853,570 | A | 12/1998 | Hatanaka et al. | 208/216 PP |
| 5,863,419 | A | 1/1999 | Huff, Jr. et al. | 208/237 |
| 5,866,749 | A | 2/1999 | Ou | 585/845 |
| 6,048,451 | A | 4/2000 | Huff, Jr. et al. | 208/237 |
| 6,059,962 | A | 5/2000 | Alexander et al. | 208/238 |

FOREIGN PATENT DOCUMENTS

| | | | |
|---|---|---|---|
| WO | WO 00/6331 | 10/2000 | C10G/25/12 |

OTHER PUBLICATIONS

Gandhi, H.S., et al., "Effects of Sulphur on Noble Metal Automotive Catalysts," Applied Catalysis V77N.2, 1998. No month.

Gonzales et al., "Can you make low–sulphur fuel and remain competitive," Hart's Fuel Tech and Management, Nov./Dec. 1996.

Salem, A.B., et al., "Removal of Sulphur Compounds from Naphtha Solutions using Solid Absorbents," Chemical Engineering and Technology, Jun. 20, 1997.

*Primary Examiner*—Nadine G. Norton
(74) *Attorney, Agent, or Firm*—Gerard J. Hughes; Jeremy J. Kliebert

(57) ABSTRACT

A process for removing sulfur compounds from hydrocarbon feedstreams, particularly those boiling in the naphtha range, by contacting the feedstream with an adsorbent comprised of cobalt and one or more Group VI metals selected from molybdenum and tungsten on a refractory support. This invention also relates to a process wherein a naphtha feedstream is first subjected to selective hydrodesulfurization to remove sulfur but not appreciably saturate olefins. A product stream is produced containing mercaptans that are removed by use of the cobalt-containing adsorbents of the present invention.

29 Claims, 3 Drawing Sheets

REMOVAL OF SULFUR COMPOUNDS FROM HYDROCARBON FEEDSTREAMS USING COBALT CONTAINING ADSORBENTS IN THE SUBSTANTIAL ABSENCE OF HYDROGEN

CROSS REFERENCE TO RELATED APPLICATIONS

This application claims benefit of Provisional U.S. Application Serial No. 60/258,505 filed Dec. 28, 2000.

FIELD OF THE INVENTION

The present invention relates to a process for removing sulfur compounds from hydrocarbon feedstreams, particularly those boiling in the naphtha range by contacting the feedstream with an adsorbent comprised of cobalt and one or more Group VI metals selected from molybdenum and tungsten on a refractory support. This invention also relates to a process wherein a naphtha feedstream is first subjected to selective hydrodesulfurization to remove sulfur but not appreciably saturate olefins. A product stream is produced containing mercaptans that are removed by use of the cobalt-containing adsorbents of the present invention.

BACKGROUND OF THE INVENTION

The presence of sulfur compounds in petroleum feedstreams is highly undesirable since they result in corrosion and environmental problems. These compounds are also responsible for reducing the performance of engines using such fuels. It has not been considered prudent in the past to transport refined hydrocarbon fluids in a pipeline previously used for the transportation of sour hydrocarbon fluids, such as petroleum crudes. The major difficulty is that refined hydrocarbon fluids, such as gasoline and diesel fuel, pick up contaminants such as elemental sulfur. About 10 to 80 mg/L of elemental sulfur is picked up by gasoline and about 1 to 20 mg/L elemental sulfur is picked up by diesel fuel when pipelined. Elemental sulfur has a particularly corrosive effect on equipment, such as brass valves, gauges, silver bearing cages in two-cycle engines and in-tank fuel pump copper commutators.

The maximum sulfur level allowable in gasoline in the U.S. is 350 wppm. In 2004, the sulfur level in motor gasoline will be legislated to less than 30 wppm. Auto emissions into the environment is one of the highest sources of atmospheric contaminants.

Refiners have a number of options to produce lower sulfur gasoline. For example, they can refine lower sulfur crudes, or they can hydrotreat refinery streams to remove contaminants via processes such as adsorption and absorption.

Hydrodesulfurization is the conventional method for removal of sulfur compounds from hydrocarbon streams. In typical hydrodesulfurization processes, a portion of the sulfur components is removed from a hydrocarbon feed stream by reaction of the sulfur components with hydrogen gas in the presence of a suitable catalyst to form hydrogen sulfide. The reactor product is cooled and separated into a gas and liquid phase, and the off-gas containing hydrogen sulfide is discharged to the Claus plant for further processing. Hydrodesulfurizing processes that treat FCC gasoline, the major sulfur source in U.S. refinery gasoline, are characterized by both an undesirable high rate of hydrogen consumption (due to olefin saturation) and a significant octane degradation. Also, these processes require severe conditions, such as high temperatures up to about 425° C. as well as pressures up to about 3000 psig.

Selective and severe hydrodesulfurization processes have also been developed to avoid extensive olefin saturation and octane loss. Such processes are disclosed, for example, in U.S. Pat. Nos. 4,049,452; 4,149,965; 5,525,211; 5,243,975 and 5,866,749. However, in these and other such processes, $H_2S$ reacts with the retained olefins in the hydrodesulfurizaton reactor and forms mercaptans. Depending on the amount of sulfur and olefins in the naphtha feedstream, the concentration of these reversion reaction product mercaptans typically exceeds fuel specifications for mercaptan sulfur and, in some cases, total sulfur as well. Therefore, removal of these mercaptans is essential to meeting the future fuel specifications with regard to sulfur level, particularly with respect to mogas pool stocks.

Gonzales et al. ("Can You Make Low-Sulfur Fuel and Remain Competitive," Hart's Fuel Technology and Management, Nov/Dec 1996) indicates that cat feed desulfurization can reduce sulfur levels in cracked naphtha to 500 wppm. However, this is an expensive option, especially if a refiner cannot take advantage of the higher gasoline conversions as a result of cat feed desulfurization. Sulfur levels lower than 200 wppm are achievable via hydrodesulfurizaton of light cracked-naphtha. However, this is incrementally even more expensive than cat feed desulfurization because of the high hydrogen consumption and loss of octane due to hydrogenating the olefins. Thus, the hydrotreated cracked-naphtha needs to undergo an isomerization step to recover some of the octane.

Caustic extraction processes, such as the Merox process, is capable of extracting sulfur from hydrocarbon feedstreams, which sulfur is in the form of mercaptan compounds. The Merox process was announced to the industry in 1959. The Oil & Gas J. 57(44), 73–8 (1959), contains a discussion of the Merox process and also of some prior art processes. The Merox process uses a catalyst that is soluble in caustic, or alternatively is held on a support, to oxidize mercaptans to disulfides in the presence of oxygen and caustic. Mercaptans are corrosive compounds that must be extracted or converted to meet an industry standard copper strip test. Sodium mercaptans are formed which are soluble in caustic solution. The caustic solution containing the mercapatan compounds is warmed and then oxidized with air in the presence of a catalyst in a mixer column that converts the mercaptan compounds to the corresponding disulfides. The disulfides, which are not soluble in the caustic solution, can be separated and recycled for mercaptan extraction. The treated hydrocarbon stream is usually sent to a water wash in order to reduce the sodium content.

Such caustic extraction processes, however, are capable of extracting sulfur only in the form of light mercaptan compounds (for example, $C_1$ to $C_4$ mercaptans) that typically accounts for less than about 10% of the sulfur present in na FCC gasoline. Problems associated with caustic extraction include: generation of hazardous liquid waste streams, such as spent caustic (which is classified as hazardous waste); smelly gas streams which arise from the fouled air effluent resulting from the oxidation step; and the disposal of the disulfide stream. Further, Merox processing problems include difficulties associated with handling a sodium and water contaminated product. Caustic extraction is able to remove only lighter boiling mercaptans while other sulfur components, such as sulfides and thiophenes, remain in the treated product streams. Also, oxygen compounds (e.g., phenols, carboxylic acids, peroxides) and nitrogen compounds (e.g., anines or nitrites) also found in FCC gasoline are not appreciably affected by the Merox process.

Adsorption is often a cost-effective process to remove relatively low levels of contaminants. Salem, A. B. et al., ("Removal of Sulfur Compounds from Naphtha Solutions Using Solid Adsorbents," Chemical Engineering and Technology, Jun. 20, 1997) reports a 65% reduction in the sulfur level (500 to 175 wppm) for a 50/50 mixture of virgin and cracked naphthas using activated carbon at 80° C. and a 30% reduction using Zeolite 13× at 80° C. Also, U.S. Pat. No. 5,807,475 teaches that Ni or Mo exchanged Zeolite X and Y can be used to remove sulfur compounds from hydrocarbon streams. Typical adsorption processes have an adsorption cycle whereby the contaminant is adsorbed from the feed followed by a desorption cycle whereby the contaminant is removed from the adsorbent.

In spite of limitations, the above mentioned processes, for the most part, provide satisfactory means for reducing the level of sulfur in refinery hydrocarbon feed streams to levels that were previously acceptable. These processes are not, however, suited for the economic reduction of heteroatom contaminants to the substantially lower levels that are now or will soon be required by governmental regulations. Thus, there is a need in the art for processes that can meet these ever stricter regulations.

SUMMARY OF THE INVENTION

In accordance with the present invention, there is provided a process for removing sulfur compounds from sulfur compound-containing hydrocarbon streams, which process comprises contacting a sulfur-containing hydrocarbon stream with an adsorbent comprised of Co and at least one Group VI metal selected from Mo and W on an inorganic support under conditions that include temperatures up to about 150° C., in the substantial absence of added hydrogen.

Also in accordance with the present invention there is provided a process for removing sulfur from sulfur compound-containing naphtha streams, which process comprises:

(a) hydrodesulfurizing said naphtha stream, which contains olefins and sulfur in the form of organic sulfur compounds, to form a hydrodesulfurization effluent at an initial temperature, the hydrodesulfurization effluent comprising a hot mixture of sulfur reduced naphtha at an initial pressure, $H_2S$ and mercaptans, and then (b) contacting said mixture with an adsorbent comprised of Co and at least one Group VI metal selected from Mo and W on an inorganic support under conditions that include temperatures up to about 150° C., in the substantial absence of added hydrogen.

In a preferred embodiment of the present invention there is provided, between step (a) and step (b) a step wherein the system is rapidly depressurized for a depressurization time at least a portion of the hydrodesulfurization effluent to destroy at least a portion of the mercaptans to form more $H_2S$ and a depressurized naphtha further reduced in sulfur In another preferred embodiment, the hydrocarbon stream is a naphtha boiling range petroleum stream.

In still another preferred embodiment, the inorganic support is selected from alumina, silica, and large pore zeolites.

In yet another preferred embodiment, the adsorbent contains from about 0.5 to about 20 wt. % Co and about 1 to about 40 wt. % of Mo and/or W.

In still another preferred embodiment, the adsorbent is preconditioned with $H_2$.

In another preferred embodiment, the adsorbent is preconditioned with a mixture of $H_2S$ and $H_2$.

DETAILED DESCRIPTION OF THE INVENTION

Figure 1:
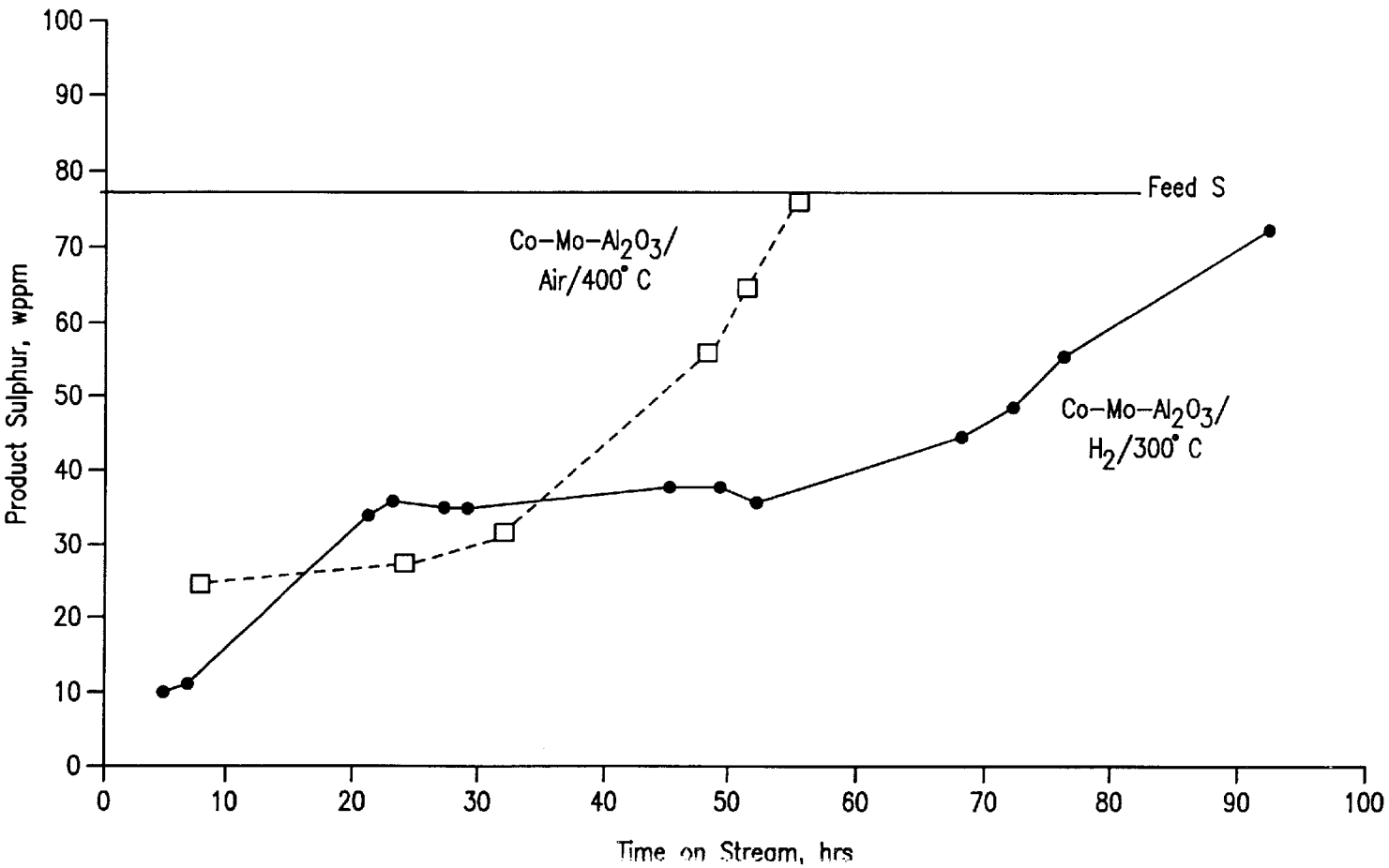
FIG. 1 is a graph showing the effect of hydrogen preconditioning on adsorbent sulfur removal in accordance with Examples 8 and 9 hereof.

The present invention comprises a method for reducing the amount of sulfur compounds in hydrocarbon feedstreams, preferably petroleum feedstreams boiling from about the naphtha (gasoline) range to about the distillate boiling range. The preferred streams to be treated in accordance with the present invention are naphtha boiling range streams that are also referred to as gasoline boiling range streams. Naphtha boiling range streams can comprise any one or more refinery streams boiling in the range from about 10° C. to about 230° C., at atmospheric pressure. The naphtha stream generally contains cracked naphtha that typically comprises fluid catalytic cracking unit naphtha (FCC catalytic naphtha), coker naphtha, hydrocracker naphtha, resid hydrotreater naphtha, debutanized natural gasoline (DNG), and gasoline blending components from other sources from which a naphtha boiling range stream can be produced. FCC catalytic naphtha and coker naphtha are generally more olefinic naphthas since they are products of catalytic and/or thermal cracking reactions. They are the more preferred streams to be treated in accordance with the present invention. For example, preferred naphtha a streams will typically contain 60 vol. % or less olefinic hydrocarbons, with sulfur levels as high as 3000 wppm and even higher (e.g. 7000 wppm). The naphtha feed, preferably a cracked naphtha feedstock, generally contains not only paraffins, naphthenes, and aromatics, but also unsaturates, such as open-chain and cyclic olefins, dienes and cyclic hydrocarbons with olefinic side chains. The olefin content of a typical cracked naphtha feed can broadly range from 5–60 vol. %, but more typically from 10–40 vol. %. In the practice of the invention it is preferred that the olefin content of the naphtha feed be at least 15 vol. % and more preferably at least 25 vol. %. The sulfur content of the naphtha feed is typically less than 1 wt. %, and more typically ranges from as low as 0.05 wt. %, up to as much as about 0.7 wt. %, based on the total feed composition. However, for a cat cracked naphtha and other high sulfur content naphthas useful as feeds in the selective desulfurization process of the invention, the sulfur content may broadly range from 0.1 to 0.7 wt. %, more typically from about 0.15 wt. % to about 0.7 wt. % with 0.2–0.7 wt. % and even 0.3–0.7 wt. % being preferred. While the feed's nitrogen content will generally range from about 5 wppm to about 500 wppm, and more typically from about 20 wppm to about 200 wppm, the preferred process is insensitive to the presence of nitrogen in the feed.

The organic sulfur compounds in a typical naphtha feed to be desulfurized, comprise mercaptan sulfur compounds (RSH), sulfides (RSR), disulfides (RSSR), thiophenes and other cyclic sulfur compounds, and aromatic single and condensed ring compounds. Mercaptans present in the naphtha feed typically have from one to three ($C_1$–$C_3$) carbon atoms. During a selective hydrodesulfurization process, the mercaptans in the feed are removed by reacting with the hydrogen and forming $H_2S$ and paraffins. It is believed that the $H_2S$ produced in the hydrodesulfurization reactor from the removal of the organic sulfur compounds reacts with the olefins to form new mercaptans (i.e., reversion mercaptans).

Generally, it has been found that the mercaptans present in the hydrodesulfurization product have a higher carbon number than those found in the feed. These reversion mercaptans formed in the reactor, and which are present in the desulfurized product, typically comprise $C_{4+}$ mercaptans. Others have proposed reducing the mercaptan and/or total sulfur of the hydrodesulfurization naphtha product by means such as 1) pretreating the feed to saturate diolefins, 2) extractive sweetening of the hydrotreated product, and 3) product sweetening with an oxidant, alkaline base and catalyst.

Non-limiting examples of hydrocarbon feed streams boiling in the distillate range include diesel fuels, jet fuels, heating oils, and lubes. Such streams typically have a boiling range from about 150° C. to about 600° C., preferably from about 175° C. to about 400° C. It is preferred that such streams first be hydrotreated to reduce the sulfur content, preferably to less than about 1,000 wppm, more preferably to less than about 500 wppm, most preferably to less than about 200 wppm, particularly less than about 100 wppm sulfur, and ideally to less than about 50 wppm. It is highly desirable to upgrade these types of feedstreams by removing as much of the sulfur as possible, while maintaining as much octane as possible. This is accomplished by the practice of the present invention primarily because hydrogen is substantially absent during the adsorption cycle, thus minimal olefin saturation occurs.

These feedstreams will typically contain sulfur compounds that need to be removed because of their corrosive nature and because of ever stricter environmental regulations. Non-limiting examples of sulfur compounds contained in such feedstocks include elemental sulfur, aliphatic, naphthenic, and aromatic mercaptans, sulfides, di- and polysulfides; thiophenes and their higher homologs and analogs.

When the feedstream is a naphtha stream and is to be first selectively hydrodesulfurized the ranges for the temperature, pressure and treat gas ratio employed for the hydrodesulfurization include those generally known and used for hydrodesulfurization generally. The table below illustrates the broad and preferred ranges of temperature, pressure and treat gas ratio of the process of the invention, in comparison with typical prior art ranges.

| Conditions | Broad | Preferred | Most Preferred |
|---|---|---|---|
| Temp. ° C. | 200–425 | 230–400 | 260–400 |
| Total Press., psig | 60–2000 | 60–600 | 60–300 |
| Treat gas ratio, scf/b | 200–10000 | 1000–4000 | 2000–4000 |

The preferred operating conditions improve the selectivity by favoring hydrodesulfurization with less olefin saturation (octane loss).

Catalysts suitable for the selective hydrodesulfurization of naphtha streams include those comprising at least one Group VIII metal catalytic component such as Co, Ni and Fe, alone or in combination with a component of at least one metal selected from Group VI, IA, IIA, IB metals and mixture thereof, supported on any suitable, high surface area inorganic metal oxide support material such as, but not limited to, alumina, silica, titania, magnesia, silica-alumina, and the like. The Group VIII metal component will typically comprises a component of Co, Ni or Fe, more preferably Co and/or Ni, and most preferably Co; and at least one Group VI metal catalytic component, preferably Mo or W, and most preferably Mo, composited with, or supported on, a high surface area support component, such as alumina. All Groups of the Periodic Table referred to herein mean Groups as found in the Sargent-Welch Periodic Table of the Elements, copyrighted in 1968 by the Sargent-Welch Scientific Company. Some catalysts employ one or more zeolite components. A noble metal component of Pd or Pt is also used. At least partially and even severely deactivated catalysts have been found to be more selective in removing sulfur with less olefin loss due to saturation.

In the practice of the invention it is preferred that the hydrodesulfurization catalyst comprise a Group VIII non-noble metal catalytic component of at least one metal of Group VIII and at least one metal of Group VIB on a suitable catalyst support. Preferred Group VIII metals include Co and Ni, with preferred Group VIB metals comprising Mo and W. A high surface area inorganic metal oxide support material such as, but not limited to, alumina, silica, titania, magnesia, silica-alumina, and the like is preferred, with alumina, silica and silica-alumina particularly preferred. Metal concentrations are typically those existing in conventional hydroprocessing catalysts and can range from about 1–30 wt. % of the metal oxide, and more typically from about 10–25 wt. % of the oxide of the catalytic metal components, based on the total catalyst weight. The catalyst may be presulfided or sulfided in-situ, by well-known and conventional methods.

In one embodiment, a low metal loaded HDS catalyst comprising CoO and $MoO_3$ on a support, in which the Co/Mo atomic ratio ranges from 0.1 to 1.0, is particularly preferred for its deep desulfurization and high selectivity for sulfur removal. By low metal loaded it is meant that the catalyst will contain not more than 12, preferably not more than 10 and more preferably not more than 8 wt. % catalytic metal components calculated as their oxides, based on the total catalyst weight. Such catalysts include: (a) a $MoO_3$ concentration of about 1 to 10 wt. %, preferably 2 to 8 wt. % and more preferably 4 to 6 wt. % of the total catalyst; (b) a CoO concentration of 0.1 to 5 wt. %, preferably 0.5 to 4 wt. % and more preferably 1 to 3 wt. % based on the total catalyst weight. The catalyst will also have (i) a Co/Mo atomic ratio of 0.1 to 1.0, preferably 0.20 to 0.80 and more preferably 0.25 to 0.72; (ii) a median pore diameter of 60 to 200 Å, preferably from 75 to 175 Å and more preferably 80 to 150 Å; (iii) a $MoO_3$ surface concentration of $0.5\times10^{-4}$ to $3\times10^{-4}$ g. $MoO_3/m^2$, preferably $0.75\times10^{-4}$ to $2.4\times10^{-4}$ and more preferably $1\times10^{-4}$ to $2\times10^{-4}$ and (iv) an average particle size diameter of less than 2.0 mm, preferably less than 1.6 mm and more preferably less than 1.4 nun. The most preferred catalysts will also have a high degree of metal sulfide edge plane area as measured by the Oxygen Chemisorption Test described in "Structure and Properties of Molybdenum Sulfide: Correlation of $O_2$ Chemisorption with Hydrodesulfirization Activity", S. J. Tauster, et al., Journal of Catalysis, 63, p. 515–519 (1980), which is incorporated herein by reference. The Oxygen Chemisorption Test involves edge-plane area measurements made wherein pulses of oxygen are added to a carrier gas stream and thus rapidly traverse the catalyst bed. Thus, the metal sulfide edge plane area will be from about 761 to 2800, preferably from 1000 to 2200, and more preferably from 1200 to 2000 $\mu$mol oxygen/gram $MoO_3$, as measured by oxygen chemisorption. Alumina is a preferred support. For catalysts with a high degree of metal sulfide edge plane area, magnesia can also be used. The catalyst support material or component will preferably contain less than 1 wt. % of contaminants such as Fe, sulfates, silica and various metal oxides which can be present during preparation of the catalyst. It is preferred that the catalyst be free of such contaminants. In one embodiment, the catalyst may also contain from up to 5 wt. %, preferably 0.5 to 4 wt. % and more preferably 1 to 3 wt. % of an additive in the support, which additive is selected from the group consisting of phosphorous and metals or metal oxides of metals of Group IA (alkali metals).

The one or more catalytic metals can be deposited incorporated upon the support by any suitable conventional means, such as by impregnation employing heat-decomposable salts of the Group VIB and VIII metals or other methods known to those skilled in the art, such as ion-exchange, with impregnation methods being preferred. Suitable aqueous impregnation solutions include, but are not limited to a nitrate, ammoniated oxide, formate, acetate and the like. Impregnation of the catalytic metal hydrogenating components can be employed by incipient wetness, impregnation from aqueous or organic media, compositing. Impregnation as in incipient wetness, with or without drying and calcining after each impregnation is typically used. Calcination is generally achieved in air at temperatures of from 260–650° C., with temperatures of from 425–590° C. being typical.

Adsorbents suitable for use herein are those comprised of: cobalt and one or more Group VI metals selected from molybdenum and tungsten on a suitable refractory support. The concentration of cobalt in terms of CoO will be from about 0.5 to about 20 wt. %, preferably about 2 to about 20 wt. %, and more preferably about 4 to about 15 wt. %. The concentration of the Group VI metal will be from about 1 to about 40 wt. %, preferably from about 5 to 30 wt. %, and more preferably from about 20 to 30 wt. %. All metals weight percents are on support. By "on support" we mean that the percents are based on the weight of the support. For example, if the support were to weigh 100 g. then 20 wt. % Co would mean that 20 g. of CoO metal was on the support.

Suitable refractory supports include metal oxides, such as alumina, silica, silica-alumina, clay, titania, calcium oxide, strontium oxide, barium oxide, carbons, zirconia, diatomaceous earth, lanthanide oxides including cerium oxide, lanthanum oxide, neodynium oxide, yttrium oxide, praesodynium oxide, chromia, thorium oxide, urania, niobia, tantala, tin oxide, zinc oxide, and aluminum phosphate. Large pore zeolites can also be used. Zeolites that can be employed in accordance with this invention include both natural and synthetic zeolites. Such zeolites include gmelinite, chabazite, dachiardite, clinoptilolite, faujasite, heulandite, levynite, erionite, cancrinite, scolecite, offretite, mordenite, and ferrierite. Included among the synthetic zeolites are zeolites X, Y, L, ZK-4, ZK-5, E, H, J, M, Q, T, Z, alpha and beta, ZSM-types and omega. Preferred are the faujasites, particularly zeolite Y and zeolite X, more preferably those having a unit cell size greater than or equal to 6 Angstroms in diameter, most preferably greater than or equal to 10 Angstroms, in diameter. The aluminum in the zeolite, as well as the silicon component can be substituted with other framework components. For example, at least a portion of the aluminum portion can be replaced by boron, gallium, titanium or trivalent metal compositions that are heavier than aluminum. Germanium can be used to replace at least a portion of the silicon portion. Preferred supports are alumina, silica, alumina-silica, and large pore zeolites.

The metals can be deposited, or incorporated, upon the support by any suitable conventional means, such as by impregnation employing heat-decomposable salts of the metals or other methods known to those skilled in the art such as ion-exchange. Impregnation methods are preferred. Suitable aqueous impregnation solutions include, but are not limited to, cobalt chloride, cobalt nitrate and ammonium molybdate. Impregnation of the metals on the support is typically done using an incipient wetness technique. The support is precalcined and the amount of water to be added to just wet all of the support is determined. The aqueous impregnation solutions are added such that the aqueous solution contains the total amount of metal component to be deposited on the given mass of support. Impregnation can be performed for each metal separately, including an intervening drying step between impregnations, or a single co-impregnation step can be used. The saturated support can then be separated, drained, and dried in preparation for calcination. Calcination generally is performed at temperatures ranging from about 250° C. to about 650° C., or more preferably from about 425° C. to about 590° C.

The present invention, with respect to adsorption, is practiced by introducing the feedstock containing the sulfur compounds into an adsorption zone containing a bed of adsorbent material at suitable conditions. Suitable conditions include temperatures up to about 150° C., preferably from about −30 ° C. to about 150° C., more preferably from about 10° C. to about 100° C. Suitable pressures are from about atmospheric pressure to about 500 psig, preferably from about atmospheric pressure to about 250 psig. The bed of adsorbent material can be of any suitable arrangement including fixed bed, slurry bed, moving bed, or ebullating bed. It is preferred that the adsorbent material be arranged as a fixed bed.

The adsorbent can be regenerated by any suitable material that will desorb the sulfur compounds from the adsorbent. Typical desorbents include nitrogen, a mixture of hydrogen and hydrogen sulfide, as well as organic solvents, both aromatic and non-aromatic. The desorbent can also be a refinery stream. It is preferred that a desorbent be used that can be easily separated from the sulfur compounds by conventional techniques, such as by hydrodesulfurization or distillation. If the selected separation technique is distillation, the boiling point of the desorbent should differ from the sulfur compounds by at least about 5° C., preferably by at least about 10° C. Preferred desorbent include nitrogen and the mixture of hydrogen and hydrogen sulfide.

The following examples are presented to illustrate the invention and are not to be taken as limiting in any way.

EXAMPLE 1

A four-foot glass column (⅝" OD×⅜" ID) was packed with 3.5' of a cobalt/molybdenum on alumina adsorbent. The adsorbent, which is designated Adsorbent A, contained 20.4 wt. % $MoO_3$; 5 wt. % CoO; and the balance being alumina. The adsorbent had a surface area of 240 $m^2/g$. Adsorbant A was used in the form of 1/16" extrudates and was placed on top of a one-inch cotton plug. A total of 60.2 grams (85 cc) of Adsorbent A was loaded into the glass column. The bottom six inches of the column was cooled to about 0° C. to minimize product loss. The column was first flooded with hexane, drained, then filled with a light cat naphtha (LCN) containing 760 wppm sulfur. The LCN was gravity fed to the column at approximately 24 cc/hr to maintain a liquid hourly space velocity (LHSV) of approximately 0.3 hr-1 (v/v/hr). Samples were taken to determine the sulfur breakthrough curve and the results are shown in Table 1 below.

TABLE 1

Sulfur Breakdown Data for Adsorbent A (Example 1)

| Time on Stream (hrs) | Product Sulfur (wppm) |
|---|---|
| 1 | 100 |
| 2 | 190 |
| 3 | 290 |
| 4 | 360 |
| 5.5 | 420 |
| 6.5 | 450 |
| 7.5 | 480 |
| 8.5 | 530 |
| 9.5 | 540 |

Table 1 shows that sulfur breakthrough (where the product sulfur level is the same as the feed) was not achieved with Adsorbent A even after 10 hours of operation.

EXAMPLE 2

(Preparation of Adsorbent B)

101 grams of $CoCl_2$ was dissolved in 500 ml of de-ionized water thereby forming a $CoCl_2$ solution. 100 ml of this $CoCl_2$ solution was added to 57 grams of a high-silica Faujasite (Si/A1>1.5) (available from UOP as HiSiV—1000-1/16" extrudates) in a 1000 ml-flask fitted with a cork and thermometer on the top. A nitrogen tube was passed through a vacuum hose connection nipple. This Co—HiSiV—1000 adsorbent is designated Adsorbent B and contains 4.8 wt. % CoO, based on the total weight of the adsorbent.

The 1000 ml-flask and contents were placed on a hot-plate with the temperature maintained between 75° C.–90° C. for 8 hours. Sufficient nitrogen was bubbled through the tube to agitate the mixture during this time. After 8 hours the extrudates were washed five times with 500 ml of de-ionized water, dried in a vacuum oven at 90° C. overnight and then air calcined at 350° C. in a muffle furnace for 3 hours.

EXAMPLE 3

A four-foot glass column (5/8" OD×3/8" ID) was packed with 3.5' of Adsorbent B and placed on top of a one inch cotton plug. A total of 52 grams (85 cc) of Adsorbent B was loaded into the glass column. The bottom six inches of the column was cooled to 0° C. to minimize product losses. The column was first flooded with hexane, drained, then filled with light cat naphtha (LCN) containing 760 wppm sulfur. The LCN was gravity-fed to the column at approximately 24 cc/hr to maintain a liquid hourly space velocity (LHSV) of approximately 0.3 hr-1 (v/v/h). Samples were taken to obtain the sulfur breakthrough data and the results are shown in Table 2 below.

TABLE 2

Sulfur Breakthrough Data for Adsorbent B (Example 3)

| Time on Stream (hrs) | Product Sulfur (wppm) |
|---|---|
| 1 | 150 |
| 2 | 280 |
| 3.3 | 380 |
| 5 | 450 |
| 6 | 460 |

TABLE 2-continued

Sulfur Breakthrough Data for Adsorbent B (Example 3)

| Time on Stream (hrs) | Product Sulfur (wppm) |
|---|---|
| 7 | 480 |
| 8 | 510 |
| 9 | 520 |
| 10 | 540 |

The data of Table 2 shows that sulfur breakthrough was not en after 10 hours of operation.

EXAMPLE 4

A two-foot 316 SS column (1.1" ID) was packed with five inches of Adsorbent A (1/20" extrudes) sandwiched in between two 1" stainless steel wool plugs. A total of 60 grams (85 cc) of Adsorbent A was loaded into the metal column. Adsorbent A was calcined in air at 400° C. for approximately 2 hours. After allowing the column to cool down to ambient temperature, the adsorbent was flooded with hexane and then flushed with PUL containing 85 wppm sulfer. The PUL was pumped up-flow through the column at approximately 60 cc/hr to maintain a liquid hourly space velocity of approximately 0.8 hr-1. The column was operated at an ambient temperature. The product from the column was cooled to 0° C. to minimize losses. Regular samples were taken to ascertain the sulfur breakthrough curve. The sulfur breakthrough curves were used to calculate the sulfur adsorption capacity of Adsorbent A and the results are shown in Table 3 below.

EXAMPLE 5

A two-foot 316SS column (1.1" ID) was packed with five inches of $Al_2O_3$ adsorbent (14/28 mesh extrudates) sandwiched in between two 1" stainless steel wool plugs. A total of 60 grams (85 cc) of $Al_2O_3$ adsorbent was loaded into the metal column. The $Al_2O_3$ adsorbent was calcined in air at 400° C. for approximately 2 hours. After allowing the column to cool down to ambient temperature the adsorbent was flooded with hexane and then flushed with PUL containing 77 wppm sulfur. The gasoline was pumped up-flow through the column at approximately 60 cc/hr to maintain a liquid hourly space velocity (LHSV) of approximately 0.8 hr-1. The column was operated at ambient temperatures (approximately 22° C.). The product from the column was cooled to 0° C. to minimize losses. Regular samples were taken to ascertain the sulfur breakthrough curve. The sulfur breakthrough curves were used to calculated the sulfur adsorption capacity of $Al_2O_3$ and the results are shown in Table 3 below.

TABLE 3

Comparison of Absorbent and Al203 Sulfur Capacity

| Absorbent | AbsorbentA (Example 12) | Al203 (Example 13) |
|---|---|---|
| Feed Sulfur, wppm | 85 | 77 |
| Sulfur Capacity, gm S/100 gms ads | 0.23 | 0.14 |

As shown in Table 3 the sulfur removal performance and sulfur capacity of Adsorbent A is significantly higher than $Al_2O_3$ by itself (i.e., 64% increase in the sulfur capacity).

EXAMPLE 6

A sample of Adsorbent A was calcined in air at 400° C. for approximately 2 hours. The top portion of a three-foot 316SS column (0.62" ID) was packed with sixteen inches of hot Adsorbent A (1/20" extrudates). The bottom portion of the column was packed with 16 inches of 4 Å molecular sieve to remove residual water. The two beds were sandwiched in between two 1" stainless steel wool plugs. The column was then purged with nitrogen. A total of 62 grams (85 cc) of Adsorbent A and 85 cc of 4 Å molecular sieve was loaded into the metal column. PUL was pumped up-flow through the column at approximately 935 cc/hr to maintain a liquid hourly space velocity (LHSV) of approximately 11 hr-1. The column was operated at ambient temperatures (approximately 22° C.). The product from the column was cooled to 0° C. to minimize losses. Regular samples were taken to ascertain the sulfur breakthrough curve. The sulfur breakthrough curves were used to calculated the sulfur adsorption capacity of Adsorbent A and the results are shown in Table 4 below.

EXAMPLE 7

A Mo on $Al_2O_3$ adsorbent was prepared as follows. 72 grams of 14/28 mesh gamma-$Al_2O_3$ (Alcoa HiQ/G250 1/16" extrudates) were ground and sieved through 14 and 28 mesh screens. 85 grams of ammonium molbydate was added to a sufficient quantity of deionized water to make up a 200 cc solution. The solution was stirred, yielding a cloudy, supersaturated mixture. The solution was then decanted off into a dish containing the 14/28/mesh $Al_2O_3$ and allowed to soak overnight. The excess liquid was then decanted off. The remaining solids were dried in the oven and then calcined at 455° C. for 2 hours.

The top portion of a three-foot 316SS column (0.62" ID) was packed with sixteen inches of hot Mo on $Al_2O_3$ adsorbent. The bottom portion of the column was packed with 16 inches of 4 Å molecular sieve to remove residual water. Previous tests showed that 4 Å molecular sieves do not remove any sulfur compounds in the gasoline. The two beds were sandwiched in between two 1" stainless steel wool plugs. The column was then purged with nitrogen. A total of 64 grams (85 cc) of Mo on $Al_2O_3$ adsorbent and 85 cc of 4 Å molecular sieve was loaded into the metal column. PUL was pumped up-flow through the column at approximately 935 cc/hr to maintain a liquid hourly space velocity (LHSV) of approximately 11 hr-1. The column was operated at ambient temperatures. The product from the column was cooled to about 0° C. to minimize losses. Regular samples were taken to ascertain the sulfur breakthrough curve. The sulfur breakthrough curves were used to calculated the sulfur adsorption capacity of Mo on $Al_2O_3$.

TABLE 4

Comparison of Absorbent A and Moly-Al203 Sulfur Capacity

| Absorbent | AbsorbentA (Example 6) | Mo-Al203 (Example 7) |
|---|---|---|
| Feed Sulfur, wppm | 77 | 77 |
| Sulfur Capacity, gm S/100 gms ads | 0.20 | 0.11 |

As shown in Table 4 above the sulfur removal performance and sulphur capacity of Adsorbent A is significantly higher than Mo on $Al_2O_3$ by itself (i.e., 82% increase in the sulphur capacity).

EXAMPLE 8

A two-foot 316 stainless (SS) column (1.1° ID) was packed with five inches of Adsorbent A sandwiched in between two 1" stainless steel wool plugs. Adsorbent A was conditioned in air at 400° C. for approximately 2 hours.

A total of 60 grams (85 cc) of Adsorbent A was loaded into the metal column. The product was cooled to 0° C. to minimize losses. The column was first flooded with hexane, then flushed with premium unleaded gasoline (PUL) containing 77 wppm sulfur. The PUL was pumped up-flow through the column at approximately 60 cc/hr to maintain a liquid hourly space velocity (LHSV) of approximately 0.8 hr-1. The column was operated at ambient temperatures (approximately 22° C.). Regular samples were taken to ascertain the sulfur breakthrough curve.

EXAMPLE 9

The procedure of Example 8 was followed except that the adsorbent was treated with hydrogen at 300° C. for 2 hours after being treated in air at 400° C. for 2 hours.

The breakthrough curves for Adsorbent A preconditioned in air and Adsorbent A preconditioned in hydrogen are shown in FIG. 1 hereof. The sulfur capacities of Adsorbent A were calculated to be proportional to the area between the feed sulfur line and the breakthrough curves. As shown in FIG. 1 hereof the area between the feed line and the breakthrough curve for Adsorbent A preconditioned with hydrogen is significantly larger than that for Adsorbent A preconditioned with air.

Table 5 below compares the sulfur capacities for Adsorbent A preconditioned in air (Example 8) and hydrogen (Example 9). As shown, preconditioning Adsorbent A in hydrogen compared to air increases the sulfur capacity by approximately 80% (from 0.18 to 0.32 lbs S/100 lbs absorbent).

TABLE 5

Effect of Adsorbent Conditioning on Sulfur Capacity

| Preconditioning @300° C./2 Hr | Air | Hydrogen |
|---|---|---|
| Sulfur Capacity, lbs S/100 lbs adsorbent | 0.18 | 0.32 |

EXAMPLE 10

A three-foot 316 SS column (0.62" ID) was packed with sixteen inches of dried Adsorbent A sandwiched between two stainless steel wool plugs. A total of 60 grams (85 cc) of Adsorbent A with particle sizes ranging between 14 and 28 mesh were loaded hot into the column and then purged with dry nitrogen. PUL containing 77 wppm sulfur was first pumped up-flow through a column containing a 16" bed of 4 Å molecular sieves to remove water in the feed and then through the Adsorbent A column. The flow rate was maintained at approximately 16 cc/min which produced a mass flux rate of 2 usgpm/$ft^2$ through the Adsorbent A column. Both columns were operated at ambient temperature. The product was cooled to about 0° C. to minimize losses due to evaporation. Numerous samples were taken during the run to ascertain the sulfur breakthrough curve. Previous tests showed that the 4 Å molecular sieve bed did not absorb any sulfur compounds from the feed.

EXAMPLE 11

The procedure of Example 10 was followed except that the Adsorbent A in the column was preconditioned with 10 mole % $H_2S$ in $H_2$ at 2–3 scf/hr. During the preconditioning step the column temperature was held at 100° C. for approximately 15 minutes, then increased to 300° C. at 10° C./15 min and finally held at 300° C. for 2 hours. The Adsorbent A was contacted with the PUL after being allowed to cool to ambient temperature.

EXAMPLE 12

The procedure of Example 10 was followed except $H_2$ was used alone during preconditioning instead of $H_2S$ and $H_2$.

Figure 2:
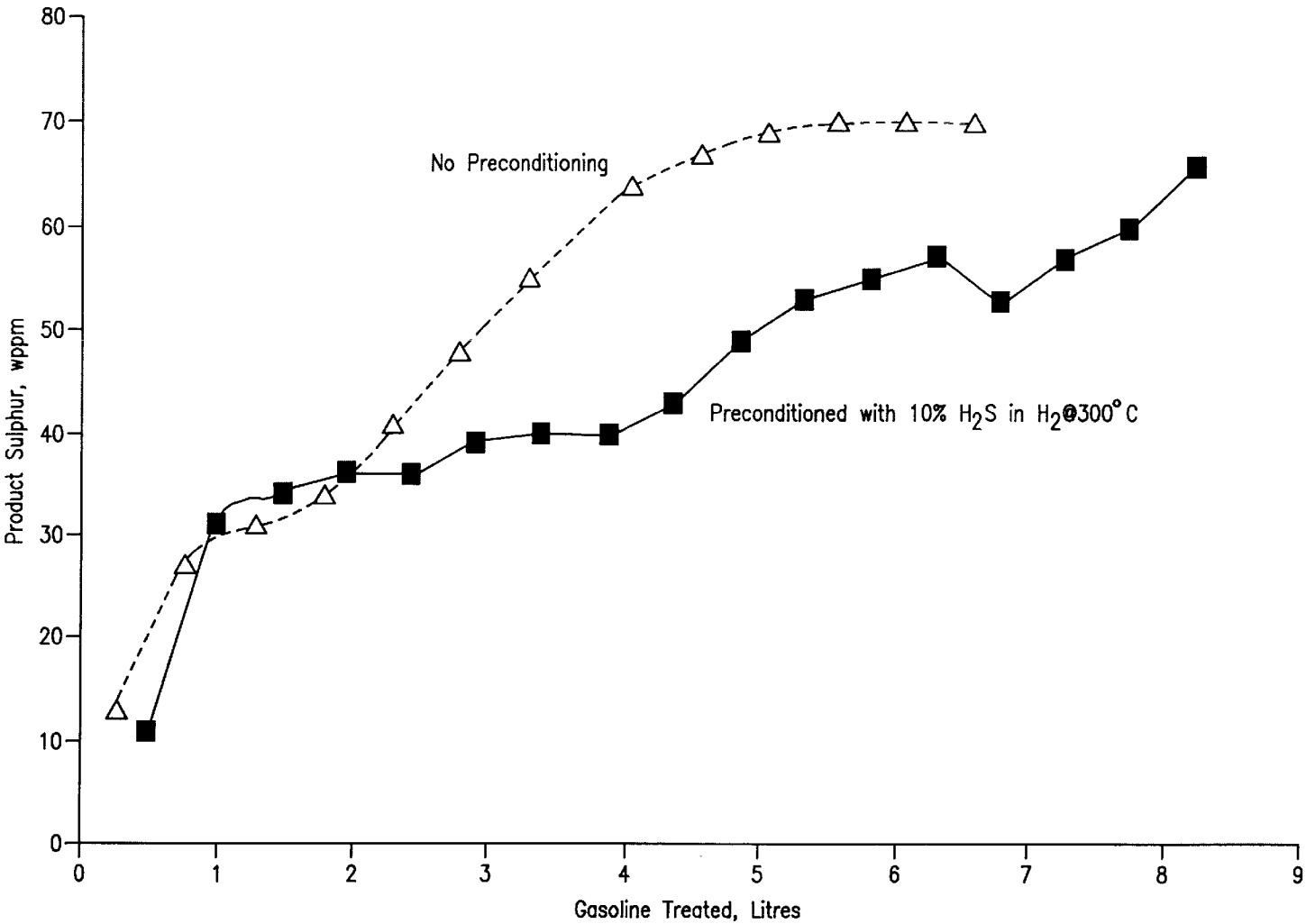
FIG. 2 is a graph showing the effect of $H_2S/H_2$ preconditioning on adsorbent sulfur removal in accordance with Examples 10 and 11 hereof.

The breakthrough curves for dried Adsorbent A (Example 10) and dried Adsorbent A preconditioned in $H_2S/H_2$ (Example 11) are shown in FIG. 2 hereof. The equilibrium sulfur capacities of the Adsorbent A samples were calculated. Table 6 below compares the equilibrium sulfur capacities for the Adsorbent A samples dried in air and preconditioned in $H_2S/H_2$. As shown, preconditioning Adsorbent A in $H_2S/H_2$ increases the sulfur capacity by approximately 70% (from 0.20 to 0.33 lbs S/100 lbs adsorbent).

TABLE 6

Effect of $H_2S/H_2$ Preconditioning on Equilibrium Sulfur Capacity

| Preconditioning | Dried | Dried/$H_2S/H_2$@300° C. |
|---|---|---|
| Equilibrium Sulfur Capacity, lbs S/100 lbs adsorbent | 0.20 | 0.33 |

Figure 3:
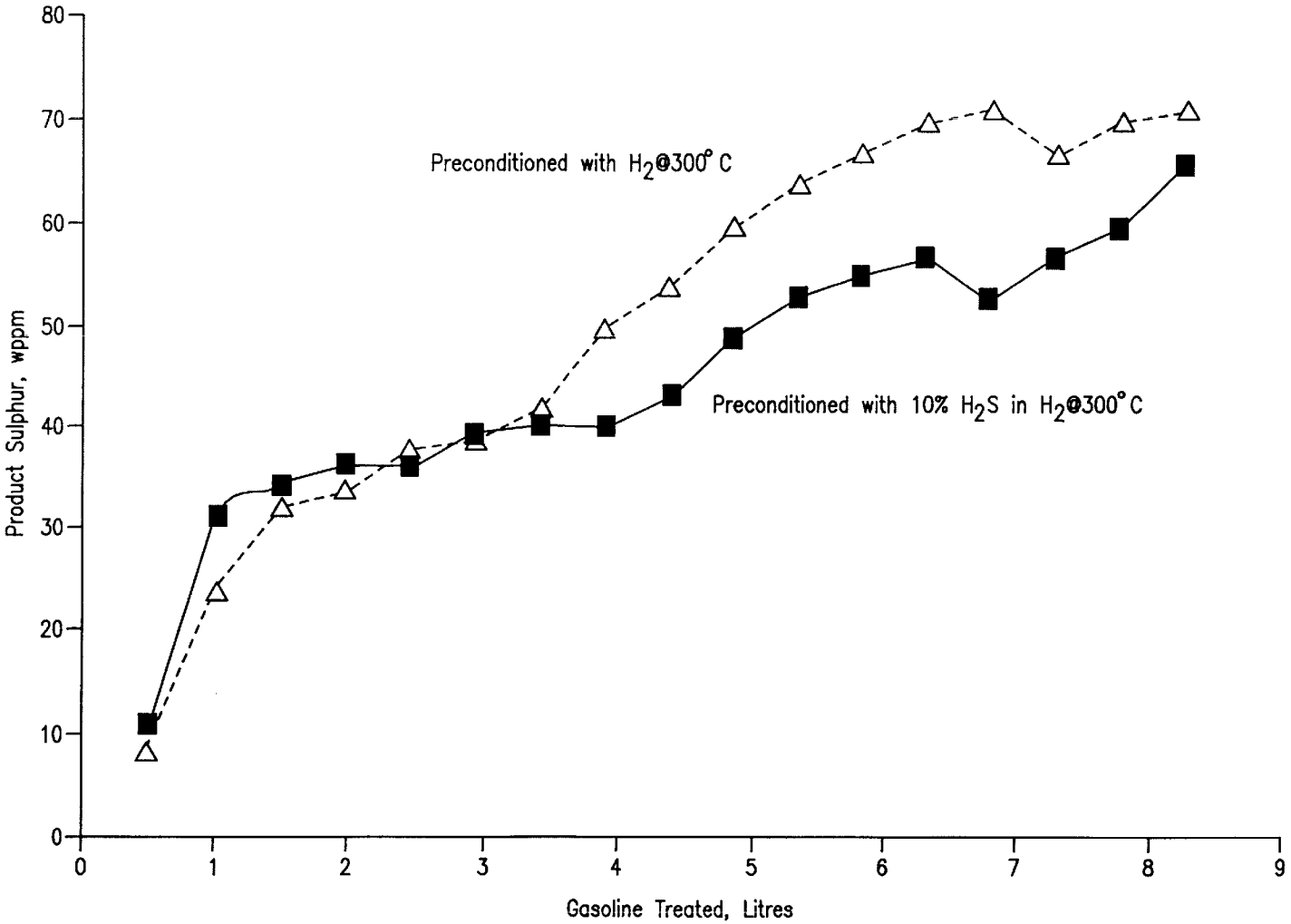
FIG. 3 is a graph showing a comparison of $H_2S/H_2$ versus $H_2$ preconditioning on adsorbent sulfur removal in accordance with Examples 12 and 13 hereof.

The breakthrough curves for dried Adsorbent preconditioned in $H_2$ (Example 12) and $H_2S/H_2$ (Example 11) are shown in FIG. 3 hereof. The equilibrium sulfur capacities of the Adsorbent A samples were calculated and are shown in Table 7 below which compares the equilibrium sulfur capacities for the Adsorbent A samples preconditioned in $H_2$ and preconditioned in $H_2S/H_2$. As shown preconditioning dried Adsorbent A in $H_2S/H_2$ compared to $H_2$ increases the sulfur capacity by approximately 25% (from 0.27 to 0.33 lbs S/100 lbs adsorbent).

TABLE 7

Effect of $H_2S/H_2$ and $H_2$ Preconditioning on Equilibrium Sulfur Capacity

| Preconditioning | $H_2$@300° C. | $H_2S/H_2$@300° C. |
|---|---|---|
| Equilibrium Sulfur Capacity, lbs S/100 lbs adsorbent | 0.27 | 0.33 |

EXAMPLE 13

A sample of Adsorbent A was ground to a fine powder and then calcined for one hour at 400° C. Five grams of calcined Adsorbent A and 50 grams of PUL containing 77 wppm sulfur were loaded into a one-liter, nitrogen-purged, glass-lined-metal vessel. The vessel was capped and then pressured to 50 psig with nitrogen. The vessel and its contents were kept at ambient temperature for four hours and swirled every 20 minutes to ensure good contact between Adsorbent A and the gasoline.

EXAMPLE 14

Example 13 was repeated except the vessel and its contents were maintained at 70° C. for four hours in a forced-air oven and swirled every 20 minutes to ensure good contact between Adsorbent A and the PUL.

EXAMPLE 15

50 grams of PUL containing 77 wppm sulfur was loaded into a one-liter, nitrogen-purged, glass-lined-metal vessel. The vessel was capped and then pressured to 50 psig with nitrogen. The vessel and its contents were maintained at 70° C. for four hours in a forced-air oven and swirled every 20 minutes. The results from Examples 13, 14 and 15 are summarized in Table 8 below.

TABLE 8

Effect of Temperature on Cobalt-Molybendium Al203 Sulfur Absorption

| Temperature, ° C. | Blank @ 70° C. (Example 11) | 20 (Example 9) | 70 (Example 10) |
|---|---|---|---|
| Feed Sulfur, wppm | 77 | 77 | 77 |
| Product Sulfur, wppm | 77 | 28 | 27 |
| Sulfur Capacity, gm S/100 gms ads | 0 | 0.049 | 0.05 |
| Sulfur Removal, % | 0 | 64 | 65 |

As shown in Table 8 above, increasing the temperature from 20 to 70° C. has little effect on the sulfur removal performance of Adsorbent A. The data also shows that the walls of the vessel did not remove any sulfur.

U.S. Pat. No. 5,157,201 teaches "adsorbing sulfur species in the absence of extraneously added hydrogen at a temperature within the range of about 50° C. to about 75° C. . . . from a hydrocarbon stream" ("olefins selected from the group consisting of ethylene, propylene, butene, mixtures of ethylene, propylene, butene and mixtures of ethylene, propylene, butene with ethane, propane and butane") by use of a catalyst (i.e., cobalt oxide, molybdenum oxide on alumina) "to form a resultant hydrocarbon stream consisting essentially of olefins containing a reduced amount of at least one sulfur species". In contrast to the present invention, Table 1 of U.S. Pat. No. 5, 157, 201 shows a significant increase in the sulfur removal performance when the temperature is increased from 50 to 75° C. The significant increase may be due to absorption rather than adsorption. Absorption involves a reaction between the low molecular sulfur species in the $C_2/C_3/C_4$ stream and the Co—Mo—$Al_2O_3$ while adsorption that does NOT involve a reaction but rather a physical attraction between two components may be occurring between the higher molecular weight sulfur species in naphtha streams such as gasoline and the Co—Mo—$Al_2O_3$.

What is claimed is:

1. A process for removing sulfur compounds from sulfur compound-containing hydrocarbon streams boiling in the range of about 10° C. to about 600° C., which process comprises contacting the sulfur compound-containing hydrocarbon stream, in the substantial absence of added hydrogen, with an adsorbent comprised of Co and at least one Group VI metal selected from Mo and W on an inorganic refractory support under conditions that include temperatures up to about 150° C.

2. The process of claim 1 wherein the hydrocarbon stream is a naphtha stream boiling in the range of about 10° C. to about 230° C.

3. The process of claim 1 wherein the hydrocarbon stream is a distillate stream boiling in the range of about 150° C. to about 600° C.

4. The process of claim 1 wherein the Co content of the adsorbent is from about 0.5 wt. % to about 20 wt. %, in terms of CoO.

5. The process of claim 4 wherein the Group VI metal content of the adsorbent is from about 1 wt. % to about 40 wt. %.

6. The process of claim 5 wherein the Co content is from about 2 wt. % to about 20 wt. % and the Group VI metal content from about 5 wt. % to about 30 wt. % on support.

7. The process of claim 6 wherein the Co content is from about 4 wt. % to about 15 wt. % and the content of the Group VI metal is from about 20 wt. % to about 30 wt. % on support.

8. The process of claim 1 wherein said support is selected from the group consisting of alumina, silica, silica-alumina, clay, titania, calcium oxide, strontium oxide, barium oxide, carbons, zirconia, diatomaceous earth, lanthanide oxides including cerium oxide, lanthanum oxide, neodynium oxide, yttrium oxide, and praesodynium oxide; chromia, thorium oxide, urania, niobia, tantala, tin oxide, zinc oxide, and large pore zeolites.

9. The process of claim 8 wherein said support is selected from alumina, silica, alumina-silica, and large pore zeolites.

10. The process of claim 1 wherein said hydrocarbon stream is contacted with said adsorbent at a temperature from about −30° C. to about 150° C.

11. The process of claim 10 wherein said hydrocarbon stream is contacted with said adsorbent at a temperature from about 10° C. to about 100° C.

12. The process of claim 1 wherein the adsorbent is in a fixed-bed arrangement when contacted with the hydrocarbon stream.

13. The process of claim 6 wherein said support is selected from alumina, silica, alumina-silica, and large pore zeolites.

14. The process of claim 1 wherein said adsorbent is preconditioned with hydrogen.

15. The process of claim 13 wherein said adsorbent is preconditioned with hydrogen.

16. The process of claim 1 wherein said adsorbent is preconditioned with a mixture of hydrogen and hydrogen sulfide.

17. The process of claim 13 wherein said adsorbent is preconditioned with a mixture of hydrogen and hydrogen sulfide.

18. A process for removing sulfur compounds from sulfur compound-containing naphtha streams boiling in the range of about 10° C. to about 230° C., which process comprises contacting the sulfur compound-containing naphtha stream, in the substantial absence of added hydrogen, with an adsorbent comprised of Co and at least one Group VI metal selected from Mo and W on an inorganic refractory support under conditions that include temperatures from about 10° C. to about 150° C.

19. The process of claim 18 wherein the Co content of said adsorbent is from about 2 wt. % to about 20 wt. % and the Group VI metal content from about 5 wt. % to about 30 wt. % on support.

20. The process of claim 19 wherein said support is selected from alumina, silica, alumina-silica, and large pore zeolites.

21. The process of claim 20 wherein said adsorbent is preconditioned with hydrogen.

22. The process of claim 20 wherein said adsorbent is preconditioned with a mixture of hydrogen and hydrogen sulfide.

23. A process for removing sulfur compounds from sulfur compound-containing naphtha streams boiling in the range of about 10° C. to about 230° C., which process comprises contacting the sulfur compound-containing naphtha stream, in the substantial absence of added hydrogen, with an adsorbent comprised of Co and at least one Group VI metal selected from Mo and W on an inorganic refractory support under conditions that include temperatures from about 10° C. to about 150° C., wherein said adsorbent was preconditioned with hydrogen.

24. The process of claim 23 wherein the Co content of said adsorbent is from about 2 wt. % to about 20 wt. % and the Group VI metal content from about 5 wt. % to about 30 wt. % on support.

25. The process of claim 24 wherein said support is selected from alumina, silica, alumina-silica, and large pore zeolites.

26. The process of claim 23 wherein hydrogen sulfide is used in combination with hydrogen to precondition said adsorbent.

27. The process of claim 25 wherein hydrogen sulfide is used in combination with hydrogen to precondition said adsorbent.

28. A process for removing sulfur from sulfur compound-containing naphtha streams boiling in the range of about 10° C. to about 230° C., which process comprises:

a) hydrodesulfurizing said naphtha stream, which contains olefins and sulfur in the form of organic sulfur compounds, to form a hydrodesulfurization effluent at an initial temperature, the hydrodesulfurization effluent comprising a hot mixture of sulfur reduced naphtha at an initial pressure, $H_2S$ and mercaptans, and then b) contacting said mixture with an adsorbent comprised of Co and at least one Group VI metal selected from Mo and W on an inorganic support under conditions that include temperatures up to about 150° C., in the substantial absence of added hydrogen.

29. The process of claim 28 wherein there is provided, between step (a) and step (b) a step wherein the system is rapidly depressurized for a depressurization time at least a portion of the hydrodesulfurization effluent to destroy at least a portion of the mercaptans to form more $H_2S$ and a depressurized naphtha further reduced in sulfur.

* * * * *